US005100616A

United States Patent [19]

Kawasaki et al.

[11] Patent Number: 5,100,616

[45] Date of Patent: Mar. 31, 1992

[54] GAMMA-PRIME PRECIPITATION HARDENING NICKEL-BASE YTTRIA PARTICLE-DISPERSION STRENGTHENED SUPERALLOY

[75] Inventors: Yozo Kawasaki; Katsuyuki Kusunoki; Shizuo Nakazawa; Michio Yamazaki, all of Tokyo, Japan

[73] Assignee: National Research Institute for Metals, Tokyo, Japan

[21] Appl. No.: 552,821

[22] Filed: Jul. 12, 1990

[30] Foreign Application Priority Data

Jul. 13, 1989 [JP] Japan ..... 1-179079

[51] Int. Cl.[5] ..... C22C 19/05

[52] U.S. Cl. ..... 420/448; 148/410

[58] Field of Search ..... 148/410; 420/448

[56] References Cited

U.S. PATENT DOCUMENTS 4,386,976 6/1983 Benn et al. ..... 148/410
4,717,435 1/1988 Kawaski et al. ..... 148/410
4,781,772 11/1988 Benn et al. ..... 148/410

FOREIGN PATENT DOCUMENTS 63-53232 3/1988 Japan .

*Primary Examiner*—Deborah Yee
*Attorney, Agent, or Firm*—Wenderoth, Lind & Ponack

[57] ABSTRACT

A gamma-prime precipitation hardening nickel-base yttria particle-dispersion-strengthened superalloy having a composition consisting essentially, by weight %, of 3.5 to 6.0 % of Al, 7.0 to 10.0 % of Co, 8.0 to 10.5 % of Cr, 0.5 to 1.5 % of Ti, 4.0 to 6.5 % of Ta, 7.0 to 9.0 % of W, 1.5 to 2.5 % of Mo, 0.02 to 0.2 % of Zr, 0.001 to 0.1 % of C, 0.001 to 0.02 % of B, 0.5 to 1.7 % of $Y_2O_3$ and the balance being Ni. It has an excellent high-temperature creep rupture strength and a good corrosion resistance at high temperatures.

5 Claims, 1 Drawing Sheet

GAMMA-PRIME PRECIPITATION HARDENING NICKEL-BASE YTTRIA PARTICLE-DISPERSION STRENGTHENED SUPERALLOY

FIELD OF THE INVENTION

This invention relates to a gamma-prime precipitation hardening nickel-base yttria particle dispersion strengthened superalloy. More specifically, it relates to a nickel-base yttria particle-dispersion-strengthened superalloy having excellent high temperature creep rupture strength and good corrosion resistance at high temperatures.

DESCRIPTION OF THE PRIOR ART

The output or thermal efficiency of gas turbines can most effectively be increased by elevating the temperature of combustion gases. For this purpose, blade materials having high creep rupture strength at high temperatures are required. However, so far there have hardly been realized blade materials which can realize larger turbine outputs and thermal efficiency.

MA6000 (a product of INCO company, U. S. A.) is an example of conventional alloy which has a relatively high rupture strength at high temperatures. MA6000 alloy is produced by mechanically mixing an element powder, an alloy powder and a yttria powder, extruding the mixture, and subjecting the fabricated material through a zone annealing heat treatment by passing it through a furnace having a temperature of 1232° C. with a temperature gradient at a moving rate of several cm/h. The product is characterized by having a re-crystallized texture growing in the extrusion direction. The base alloy of this alloy is a nickel-base gamma-prime precpitation hardening superalloy containing gamma and gamma-prime phases, and is dispersion strengthened by fine particles of yttria. The MA6000 alloy has a better creep rupture strength in a high temperature region than an ordinary cast alloy and a single crystal alloy. In view of alloy desinging, it cannot be said to be fully reinforced by solid solution. In particular, the balance of the contents of tungsten and tantalum as high melting metals with regard to chromium is a problem.

On the other hand, the present inventors already proposed gamma-prime precipitation hardening nickel-base yttria particle dispersion strengthened superalloy having excellent creep rupture strength which is produced by mixing a fine powder of yttria with a base alloy containing less chromium than MA6000 alloy but higher contents of tungsten and tantalum, mechanically mixing them with a yttria powder, extrusion-consolidating the mixture, subjecting the consolidated product to zone annealing heat-treatment, and subjecting the product to solid-solution aging heat-treatment (Japanese Laid-Open Patent Publication No. 99438/1987 and Japanese Laid-Open Patent Publication No. 118088/1988, and the corresponding U.S. Pat. No. 4,717,435). Although these gamma-prime precipitation hardening nickel-base yttria particle-dispersion-strengthened superalloys have very high creep rupture strength at high temperature, they have poor corrosion resistance and a high density.

SUMMARY OF THE INVENTION

It is an object of this invention to improve the defects of the above nickel-base superalloy previously proposed by the present inventors and to provide a new gamma-prime precipitation hardening nickel-base yttria particle-dispersion-strengthened superalloy having a low density, good corrosion resistance at high temperature and excellent creep rupture strength in a high temperature region.

The above object is achieved in accordance with this invention by a gamma-prime precipitation hardening nickel-base yttria particle-dispersion-strengthened superalloy having a composition consisting essentially, by weight %, of 3.5 to 6.0% of Al, 7.0 to 10.0% of Co, 8.0 to 10.5% of Cr, 0.5 to 1.5% of Ti, 4.0 to 6.5% of Ta, 7.0 to 9.0% of W, 1.5 to 2.5% of Mo, 0.02 to 0.2% of Zr, 0.001 to 0.1% of C, 0.01 to 0.02% of B, 0.5 to 1.7% of $Y_2O_3$ and the balance being Ni.

DETAILED DESCRIPTION OF THE PREFERRED EMBODIMENTS

Figure 1:
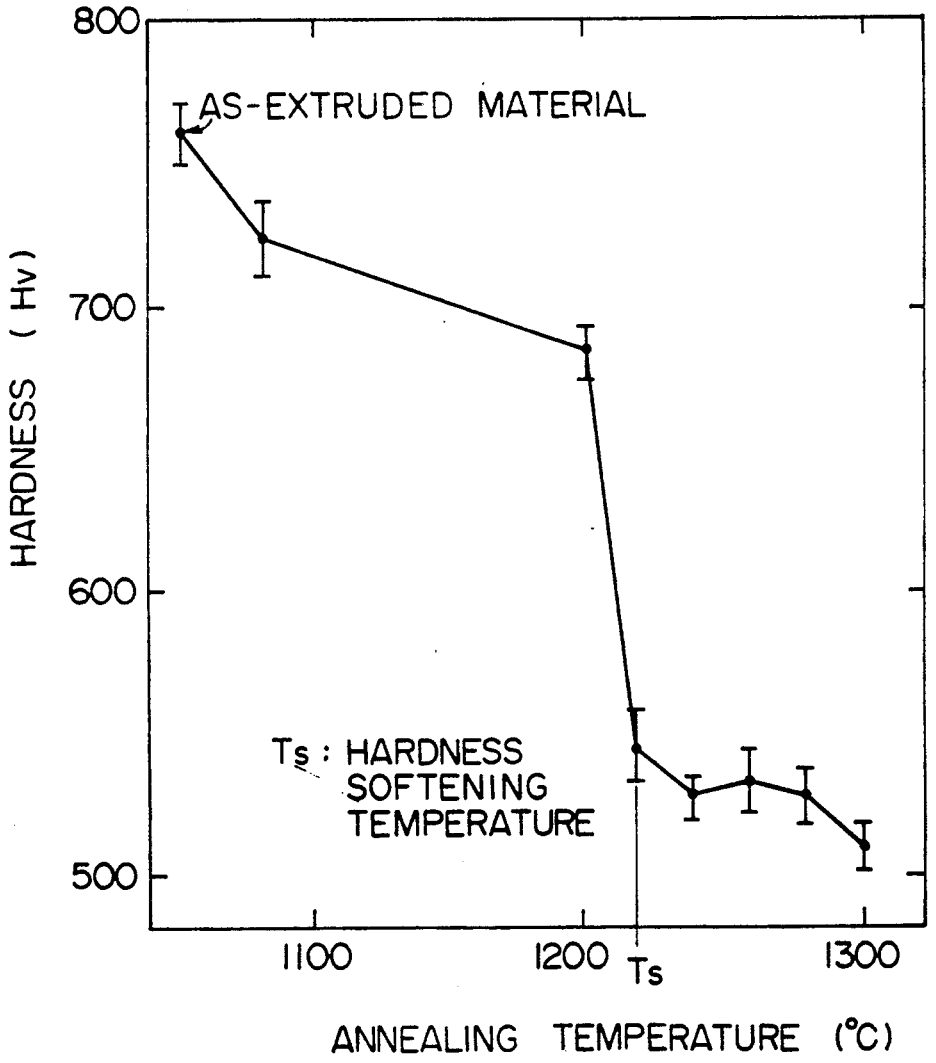
FIG. 1 is a view showing the relation between the micro-Vicker hardness (Hv) and the annealing temperature of a molded product obtained by annealing the extrusion-consolidated product of this invention for 1 hour at a predetermined temperature, and then air-cooling the product.

This invention provides a gamma-prime precipitation hardening nickel-base yttria particle dispersion strengthened superalloy having a composition consisting essentially of, by weight, 3.5 to 6.0% of Al, 7.0 to 10.0% of Co, 8.0 to 10.5% of Cr, 0.5 to 1.5% of Ti, 4.0 to 6.5% of Ta, 7.0 to 9.0% of W, 1.5 to 2.5% of Mo, 0.02 to 0.2% of Zr, 0.001 to 0.1% of C, 0.001 to 0.02% of B, 0.5 to 1.7% of $Y_2O_3$ and the balance being Ni.

As a preferred embodiment, the present invention provides a nickel-base superalloy having a crystal grain GAR of at least 15 and having a recrystallized structure having its short axis diameter grown by at least 0.1 mm in the extrusion direction, said superalloy being heat-treated after the extrusion-molding.

This alloy can be obtained by mechanically mixing elemental powders of nickel carbonyl, Co, Cr, Ta, W and Mo alloy powders of Ni-Al, Ni-Al-Ti, Ni-Zr, and Ni-B, and a fine powder of $Y_2O_3$, enclosing the composite powder into an extrusion can, extrusion-consolidating the can, and heat-treating the consolidated product by zone annealing having a maximum temperature up to the solidus temperature.

The actions of the components of the nickel-base superalloy and the proportions of the components are specified in this invention for the following reasons.

Al: Al is a necessary element for forming a gamma-prime phase. To sufficiently deposit the gamma-prime phase, Al should be included in an amount of at least 3.5% by weight. If its proportion exceeds 8.0% by weight, the gamma-prime phase excessively increases, and the toughness is lowered. Hence, the suitable proportion is 3.5 to 6.0% by weight.

Co: Co dissolves in the gamma-phase and the gamma-prime phase for solution-hardening these phases. If the amount of Co is less than 7.0% by weight, the strengthening effect is not sufficient. If its amount exceed 10.0% by weight, the strength of the alloy is lowered. Hence, it is necessary that the proportion of Co is 7.0 to 10.0% by weight.

Cr: Cr improves sulfidation resistance. If the amount of Cr is less than 8.0% by weight, the aforesaid action is difficult to obtain when the alloy is used for a long period at a temperature of not more than 1000° C. If the amount of Cr is more than 10.5% by weight, deleterious phases such as a sigma-phase or a $\mu$-phase to reduce the creep rupture strength. Accordingly, the proportion of Cr should be within a range of 8.0 to 10.5% by weight.

W: W dissolves in the gamma-phase and the gamma-prime phase to strengthen these phases greatly. For this purpose, the proportion of W should be at least 7.0% by weight. If its proportion exceeds 9.0% by weight, a W phase forms and the strength is degraded. Hence, the proportion of W is within the range of 7.0 to 9.0% by weight.

Mo: Mo has an action of depositing a carbide in the grain boundary. If its weight is less than 1.5% by weight, a sufficient amount of a carbide does not sufficiently deposit so that the grain boundary becomes weak, and the grain boundary will rupture before the substrate material shows sufficient ductility. If its amount is exceeded 2.5% by weight, a poor carbide of bad quality is accumulated in the grain boundaries during the heat treatment, the grain boundary strength is markedly weakened. Hence, the suitable amount of Mo is 1.5 to 2.5% by weight.

Ti: Most of Ti dissolves in the gamma-prime phase. Thus, Ti reinforces the gamma-prime phase, and increases the amount of the gamma-prime phase and reinforces the strength of the gamma-prime phase. For this purpose, Ti is required in an amount of at least 0.5% by weight. But if it exceeds 1.5% by weight, a $\mu$layer forms to reduce the creep rupture strength. Hence, the suitable amount of Ti should be within the range of 0.5 to 1.5% by weight.

Ta: Most of Ta dissolves in the gamma-prime phase and markedly solid-solution hardens the alloy. At the same time, it improves the ductility of the gamma-prime phase. To obtain this action, Ta is required in an amount of at least 4.0% by weight. If, however, the amount of Ta exceeds 6.5% by weight, deleterious deposited materials such as a sigma-phase occur to reduce the creep rupture life. The suitable amount is 4.0 to 6.5% by weight.

C: C forms three types of carbides, MC type, $M_{23}C_6$ type and $M_6C$ type, and have an action of mainly reinforces the grain boundary of the crystals of the alloy. To obtain this action, at least 0.001% of C is required. If its weight exceeds 0.1% by weight, deleterious carbide deposits in the form of a film in the grain boundary at the time of secondary recrystallization. Hence, the suitable amount of C is within the range of 0.001 to 0.1% by weight.

B: B segregates in the grain boundaries to increase the grain boundary strength at high temperatures, the creep rupture strength and the rupture elongation of the alloy. For this purpose, the required amount of B is at least 0.001% by weight. If the amount of B exceeds 0.02% by weight, a deleterious boride which interrupts the grain growth is deposited in a film form. Accordingly, the amount of B should be 0.001 to 0.02% by weight.

Zr: Like B, Zr has an action of reinforcing the grain boundary. For this purpose, it is required in an amount of 0.02% by weight. If its amount exceeds 0.2% by weight or more, an intermetallic compound occurs in the grain boundaries to reduce the creep rupture strength. Hence, its suitable amount is in the range of 0.02 to 0.2% by weight.

$Y_2O_3$: When yttria uniformly disperses in the base material, it increases the high-temperature creep strength. If its amount is less than 0.5% by weight, its action is not sufficient. If its amount exceeds 1.7% by weight, its strength is deteriorated. Hence, the suitable amount of $Y_2O_3$ should be 0.5 to 1.7% by weight.

Powders of single elements such as Co, Cr, Ta, W and Mo, carbonyl Ni, powders of alloys such as Ni-Al, Ni-Al-Ti, Ni-Zr, and Ni-B, and yttria fine powder are mechanically mixed to produce a mixed powder The mixed powder is enclosed in an extruding can such as a mild steel can, and consolidated. The GAR [grain aspect ratio: ratio of the longitudinal length (extrusion direction) to transverse length] of crystal grain is preferably larger than 15. If it is 15 or more, the creep strength becomes high. To obtain a coarse recrystallized structure having a short axial diameter (transverse length) of at least 0.1 mm, it is necessary that the extruding conditions and the zone annealing conditions should be proper.

Consolidating conditions such as the extrusion temperature and the extrusion ratio affect the recrystallized structure after the zone annealing. If the extrusion temperature is less than 950° C., extrusion cannot be performed, and extrusion clogging occurs. But if the extrusion temperature exceeds 1060° C., the recrystallized structure after zone annealing has a GAR smaller than 15, and the creep strength becomes lower. The extrusion temperature is preferably within the range of 950° to 1060° C.

If the extrusion ratio is less than 12, the degree of extrusion processing is insufficient, and a good recrystallized structure cannot be obtained and its GAR becomes less than 15 and the creep strength is lowered. If the extrusion ratio is at least 12, the degree of processing is sufficient, and after zone annealing, the GAR of the recrystallized structure becomes at least 15, the creep strength becomes higher.

In the zone annealing heat-treatment, the highest temperature, the moving speed and the temperature gradient of furnace affect the texture of the recrystallized structure.

If the maximum temperature of the furnace is lower than the hardness softening temperature, recrystallization does not take place. The extrusion-processed texture remains, and its creep strength is lowered. If the maximum temperature of the furnace exceeds the solidus temperature, partial dissolution occurs, the texture becomes non-uniform, and the creep strength is lowered. Accordingly, if the maximum temperature of the furnace is within the range of the hardness softening temperature to the solidus temperature of the consolidated product, recrystallized crystal grains whose short axis diameter expands at least 0.1 mm in a direction perpendicular to the extruding direction can be obtained.

As the temperature gradient of the furnace is higher, a texture having a higher GAR may be obtained. But if the temperature gradient is smaller than 200° C./ cm, the GAR of the texture becomes smaller than 15 and the creep strength is lowered. Hence, its temperature gradient is preferably at least 200° C./cm.

If the moving speed of the furnace is more than 150 mm/h, sufficent time cannot be obtained for the occurrence of recrystallization of the consolidated material. The texture becomes nonuniform and the creep strength is therefore reduced. Furthermore if the speed is less than 30 mm/h, the short axis diameter of the crystal grains becomes larger, but GAR becomes less than 15, and the creep strength is lowered. Accordingly, the moving speed of the furnace is preferably within the range of 30 to 150 mm/h.

When under the above conditions, the starting mixed powder is consolidated and subjected to zone annealing heat-treatment, there can be produced a gamma-prime precipitation hardening nickel-base yttria particle dispersion strengthened superalloy having a texture composed of recrystallized grains extending in the extrusion direction with a short axis diameter of at least 0.1 mm having a GAR of as large as more than 15.

FIG. 1 shows the relation between the annealing temperatures and the micro-Vicker hardness (Hv) measured the consolidated product annealed at various temperatures for 1 hour.

As explained in detail above, an alloy having a recrystallized texture with a high GAR can be obtained by processing an alloy component composition having a specific balance between Cr and W under specific extruding conditions and zone annealing conditions. There can be provided an alloy having a low density, improved high temperature corrosion resistance and a long creep rupture life.

The present invention will be shown by the following Examples.

EXAMPLE

Carbonyl nickel powder having an average particle diameter of 3 to 7 micrometers, as elemental powders, Cr powder having a size of −200 mesh, powders having a size of −325 mesh of W, Ta, Mo and Co, and as alloy powders, Ni-46% Al powder, Ni-28% Ti-15% Al powder, Ni-30% Zr powder, Ni-14% B powder having a size of −200 mesh, $Y_2O_3$ powder having an average particle diameter of 20 nm were used, and were mixed for 50 hours in an atmosphere of Ar according to the composition of TMO-10 shown in Table 1. In Table 1, TMO-2 "Referential Example" is given in U.S. Pat. No 4,717,453.

These ingredients were mechanically mixed. C is contained in the nickel carbonyl powder. During the mechanical mixing, the weight ratio of the steel balls to the starting powder were 50 (kg):3 (kg).

The resulting mixture was filled in a can. The can was evacuated to a vacuum of $2\times10^{-3}$ mmHg at 400° C. It was then cooled and sealed under vacuum. The mixed powder in the can was consolidated by extrusion. The conditions of the extrusion were the temperature of 1050° C., ratio of 15:1 and the ram speed of 400 mm/sec. The consolidated product was heat-treated by zone annealing. The conditions for zone annealing were a furnace speed of 100 mm/hr, and a maximum temperature of 1270° C./cm. The temperature gradient of the furnace at this time was 300° C. The annealed product recrystallized had a grain size of 0.2 to 0.5 mm x several centimeters, and a GAR of more than 20.

The so obtained gamma-prime precipitation hardening nickel-base yttria particle-dispersion-strengthened superalloy was formed into a solid solution and aging heat-treated at 1270° C.×0.5 hAc+1080° C.×4 hAc+870° C.+20 hAc, and then subjected to the creep test shown in FIG. 2. It was also tested for a high temperature corrosion test.

TABLE 1

| Alloy No. | | (Chemical composition, wt. %) Ni | Al | Co | Cr | Ti | Ta | W |
|---|---|---|---|---|---|---|---|---|
| Example | TMO-2 | balance | 4.2 | 9.7 | 5.9 | 0.8 | 4.7 | 12.4 |
| Example | TMO-10 | balance | 4.6 | 9.1 | 9.2 | 0.9 | 5.0 | 8.0 |
| Patents on alloys of like composi-tions | U.S. Pat. No. 3,926,568 | balance | 2.5–6 | 0–10 | 13–17 | 2–4.25 | 0–4 | 3.75–6.25 |
| | MA6000 | balance | 4.5 | — | 15 | 2.5 | 2.0 | 4.5 |

| Alloy No. | | Mo | Zr | C | B | $Y_2O_3$ | Remarks |
|---|---|---|---|---|---|---|---|
| Example | TMO-2 | 2.0 | 0.05 | 0.05 | 0.01 | 1.1 | density 8.6 |
| Example | TMO-10 | 2.1 | 0.05 | 0.05 | 0.01 | 1.1 | density 8.4 |
| Patents on alloys of like composi-tions | U.S. Pat. No. 3,926,568 | 1.75–4.5 | 0.02–0.5 | 0–0.2 | 0.001–0.025 | 0.4–2 | Nb 0–3 Bi 0–3 |
| | MA6000 | 4.5 | 0.15 | 0.05 | 0.05 | 1.1 | density 8.1 |

TABLE 2

(Creep Rupture Properties)

| Example | Creep conditions (°C. kgf/mm²) | | Rupture (h) | Rupture elonga-tion (%) | Reduc-tion of area (%) |
|---|---|---|---|---|---|
| Example | 1050 | 16 | 15893 | 3.9 | 5.8 |
| | 960 | 23 | 1302 | 6.0* | 7.7 |
| | 900 | 25 | 11396 | 8.0* | 9.6 |
| | 850 | 35 | 3240 | 3.9* | 4.5 |
| Referen-tial Example | 1050 | 16 | 7476 | 4.1 | 8.8 |
| | 850 | 35 | 1126 | 4.7 | 8.7 |

*The results were given for reference, and the power supply was stopped during the test, and misoperation occurred at the time of re-testing. Accordingly, the results (rupture elongation) were given for reference.

TABLE 3

| Alloy | Amount of corrosion |
|---|---|
| TMO-2 | 10 mm/h |
| TMO-10 | 0.4 mm/h |

*Keeping a piece of alloy in a salt mixture (75% $Na_2SO_4$ + 25% NaCl) open to air at 900° C. for 20 hours.

We claim:

1. A gamma-prime precipitation hardening nickel-base yttria particle-dispersion-strengthened superalloy having a composition consisting, by weight %, of 3.5 to 6.0% of Al, 7.0 to 10.0% of Co, 8.0 to 10.5% of Cr, 0.5 to 1.5% of Ti, 4.0 to 6.5% of Ta, 7.0 to 9.0% of W, 1.5 to 2.5% of Mo, 0.02 to 0.2% of Zr, 0.001 to 0.1% of C, 0.001 to 0.02% of B, 0.5 to 1.7% of $Y_2O_3$ and the balance being Ni.

2. The nickel-base superalloy of claim 1 which has a re-crystallized structure having a crystal grain GAR of at least 15 and in which the short axis diameter expands in an amount of at least 0.1 mm in the direction perpendicular to the extrusion direction.

3. The nickel-base superalloy of claim 1 which has a re-crystallized texture which has a GAR of at least 15 and in which the short axis diameter expands in an amount of at least 0.1 mm in a direction perpendicular to the extrusion direction, said alloy having been heat-treated after extrusion consolidation.

4. The nickel-base superalloy of claim 1, 2 or 3 in which a mixed powder obtained by mechanically mixing elemental powders of carbonyl Ni, Co, Cr, Ta, W and Mo, alloy powders of Ni-Al, Ni-Al-Ti, Ni-Zr, and Ni-B alloys, and $Y_2O_3$ to form a mixed powder has been extrusion-consolidated, and the consolidated material then subjected to zone annealing heat-treatment having a maximum temperature within the range of from the hardness softening temperature to the solidus temperature.

5. The nickel-base superalloy of claim 4 which has been obtained by extrusion at a temperature of 950° to 1060° C. and an extrusion ratio of at least 12.

* * * * *